US007540094B2

(12) United States Patent
Okada

(10) Patent No.: US 7,540,094 B2
(45) Date of Patent: Jun. 2, 2009

(54) CUTTER KNIVES FOR SLASH-QUILTS

(75) Inventor: Shoji Okada, Sakai (JP)

(73) Assignee: Olfa Corporation, Osaka-shi, Osaka (JP)

( * ) Notice: Subject to any disclaimer, the term of this patent is extended or adjusted under 35 U.S.C. 154(b) by 19 days.

(21) Appl. No.: 11/240,724

(22) Filed: Sep. 29, 2005

(65) Prior Publication Data

US 2006/0150426 A1 Jul. 13, 2006

(30) Foreign Application Priority Data

Jan. 11, 2005 (JP) ..... 2005-003543

(51) Int. Cl.
*B26B 29/00* (2006.01)

(52) U.S. Cl. ..... 30/287; 30/294

(58) Field of Classification Search ..... 30/2, 30/206, 240, 263, 264, 286, 287, 288, 289, 30/293, 294, 292, 282, 306, 307, 317, 319; D8/98, 102; 83/466.1, 821, 829; 144/176, 144/218

See application file for complete search history.

(56) References Cited

U.S. PATENT DOCUMENTS

| | | | | | |
|---|---|---|---|---|---|
| 844,414 | A * | 2/1907 | Seabloom | 30/371 |
| 1,382,350 | A * | 6/1921 | Gleason | 30/371 |
| 1,465,075 | A * | 8/1923 | Di Carlo | 30/307 |
| 1,553,449 | A * | 9/1925 | Kennedy | 30/294 |
| 2,394,138 | A * | 2/1946 | Barrett | 30/164.95 |
| 2,645,010 | A * | 7/1953 | Holmes | 30/144 |
| 2,883,746 | A * | 4/1959 | Gilsi | 30/205 |
| 4,821,609 | A * | 4/1989 | Rushbrook et al. | 81/45 |
| 4,833,956 | A * | 5/1989 | Roberts | 83/56 |
| 5,123,168 | A * | 6/1992 | Lyons | 30/382 |
| 5,561,905 | A * | 10/1996 | Sherman | 30/280 |
| D409,071 | S * | 5/1999 | Reidenbach | D8/102 |
| 6,240,645 | B1 | 6/2001 | Ozeki | |
| 6,282,794 | B1 * | 9/2001 | Cho et al. | 30/151 |
| 6,513,249 | B2 * | 2/2003 | Linton et al. | 30/286 |
| 6,665,943 | B1 * | 12/2003 | Sloane et al. | 30/276 |
| 2005/0229403 | A1 * | 10/2005 | Diaz | 30/294 |

FOREIGN PATENT DOCUMENTS

| | | |
|---|---|---|
| JP | 3048727 | 5/1991 |

* cited by examiner

*Primary Examiner*—Hwei-Siu C Payer
(74) *Attorney, Agent, or Firm*—Crowell & Moring LLP

(57) ABSTRACT

A cutter knife for making slash-quilts is provided, which has a plurality of guide members having different width dimensions. Further, a plurality of slits are formed between each of the guide members and the casing of the cutter knife, in each of the slits a blade edge is exposed. Since one cutter knife is provided with a plurality of guide members having different widths, the one cutter knife can be widely used for making a variety of slash-quilts having different pitch widths between stitch lines, without need for exchanging the guide members. A user can select one guide member having a suitable width dimension for a certain pitch width between the stitch lines, and insert the selected guide member between the stitch lines of a quilt. Then, the user pulls the cutter knife backward to himself, or pushes it forward to cut the quilt, and the slash-quilts is made.

8 Claims, 10 Drawing Sheets

CUTTER KNIVES FOR SLASH-QUILTS

BACKGROUND OF THE INVENTION

1. Field of the Invention

The present invention relates to cutter knives for slash-quilts.

2. Description of the Related Art

Fancy cloths called slash-quilt are known as materials for porches, bags, etc. As shown in FIG. 1, a slash-quilt cloth is made by superposing a plurality of cloths on one another, stitching them along a plurality of parallel stitch lines 6, and cutting the layers of cloths 5*a* between the parallel stitch lines 6 (see the arrow "X" in FIG. 1) except the lowermost layer 5, which is not cut and left to remain. The slash-quilt cloth thus obtained has unique and bulky feeling, or beauty.

As one of the cutter knives for making such slash-quilt cloths, a cutter knife disclosed in Japanese Utility Model Registration No. 3048727 is known. In the cutter knife disclosed in Japanese Utility Model Registration No. 3048727, the guide member for leading the cutting direction while an user is cutting a cloth is formed integrally with the casing of the cutter knife or is screwed to the casing of the cutter knife. Therefore, the replacement of the guide member is impossible, or may be burdensome.

In making of a slash-quilt cloth, it is desirable that the dimension of the overall width of the guide member is substantially equal to the pitch width between the parallel stitch lines 6, in order to smoothly cut the upper cloths 5*a* under a proper tension. On the other hand, the dimensions of the pitch width between the parallel stitch lines 6 will vary in many kinds of slash-quilts. Therefore, it is desirable to easily exchange the guide member for other ones having a various dimensions of overall width.

According to the cutter knife in Japanese Utility Model Registration No. 3048727, in the case that the guide member is formed integrally with the casing of the cutter knife, it is impossible to exchange the guide member of the cutter knife for other ones. Otherwise, in the case that the guide member is screwed to the casing of the cutter knife, exchange of the guide member for other ones is burdensome. Therefore, the cutter knives disclosed in Japanese Utility Model Registration No. 3048727 are unsuitable for widely use in making a variety kinds of slash-quilt cloths having different pitch widths between the stitch lines.

SUMMARY OF THE INVENTION

It is therefore an object of the present invention to provide a cutter knife for slash-quilts, with which a plurality of guide members having different width dimensions can be utilized, without exchanging the guide members.

In order to achieve the object of the present invention, there is provided a cutter knife for slash-quilts, comprising: a plurality of guide members having different width dimensions, which are formed on a casing of the cutter knife; and a plurality of slits formed between each of the guide members and the casing of the cutter knife, in each of the slits a blade edge is exposed.

The cutter knife for slash-quilts of the present invention constructed as above is provided with a plurality of guide members having different widths. Therefore, it becomes possible to widely use one cutter knife to make a variety of slash-quilts having different pitch widths between stitch lines, by appropriately selecting a suitable one guide member from the plurality of guide members. For which, there is no need for exchanging the guide members.

Between each of the guide members and the casing of the cutter knife, there is provided a slit, and a blade edge is exposed in the slit. Thus, a user can select one guide member having a suitable width dimension, and insert it between the stitch lines of a quilt. Then, the user pulls the cutter knife backward to himself (or, pushes it forward) to cut the quilt.

BRIEF DESCRIPTION OF THE DRAWINGS

These and other objects and features of the present invention will become apparent from the following description taken in conjunction with the preferred embodiments thereof with reference to the accompanying drawings.

DETAILED DESCRIPTION OF THE PREFERRED EMBODIMENT

Hereinafter, the embodiments of the present invention will be explained in detail with reference to the accompanying drawings.

First Embodiment

Figure 1:
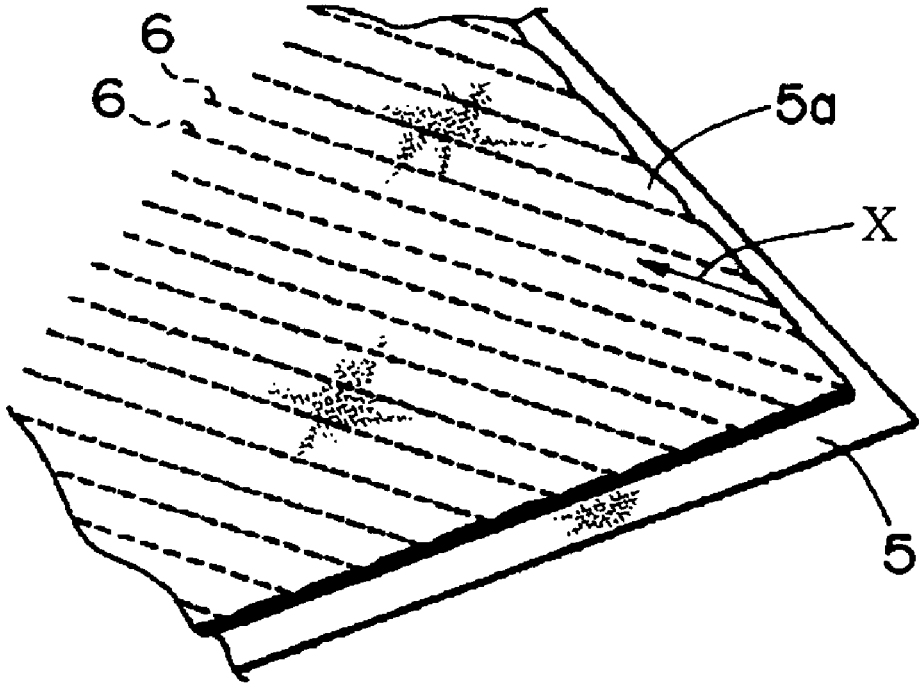
FIG. 1 is a partial perspective view of a slash-quilt cloth.
Figure 2:
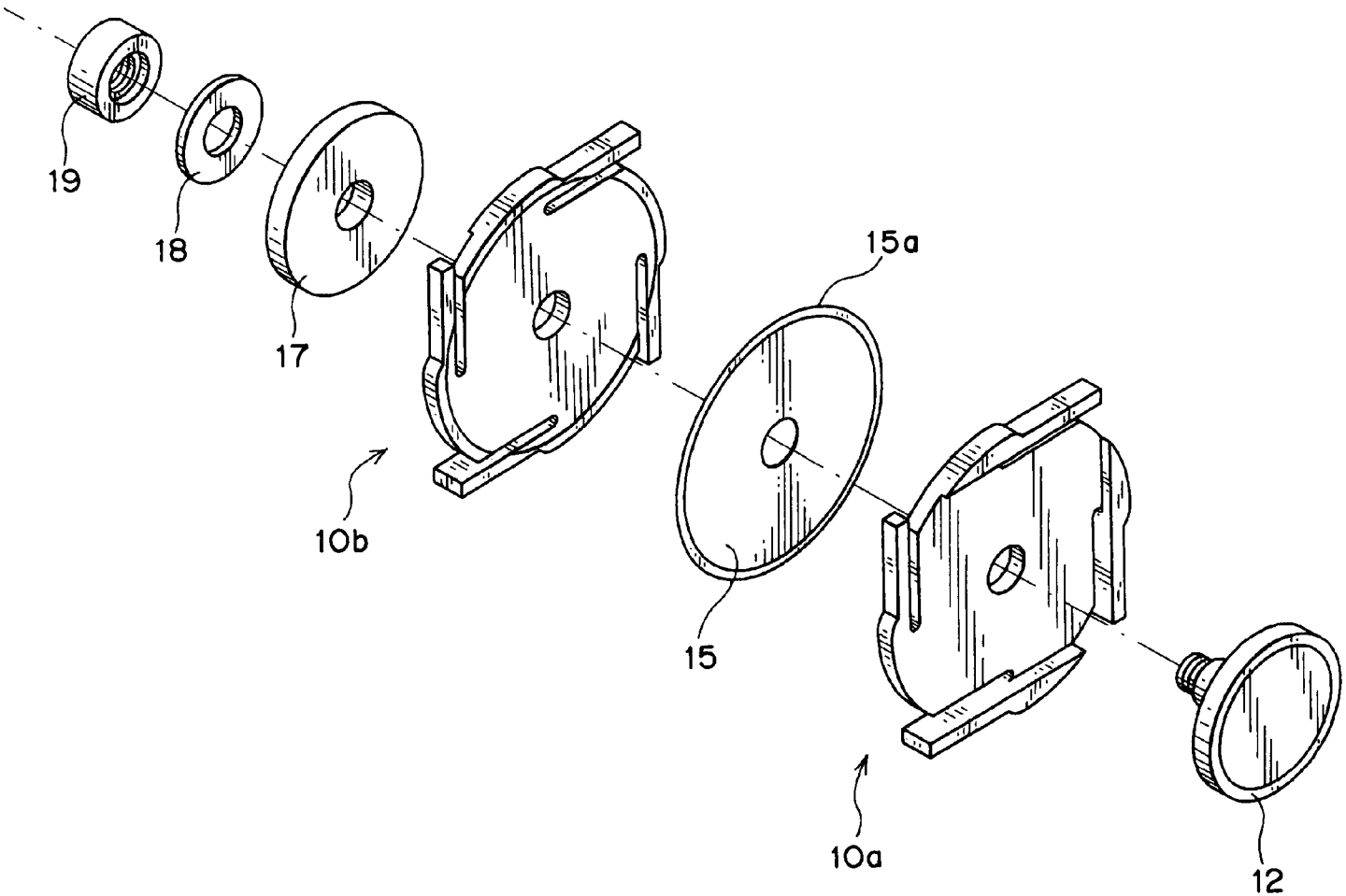
FIG. 2 is an exploded perspective view of a cutter knife according to the first embodiment of the present invention.
Figure 3:
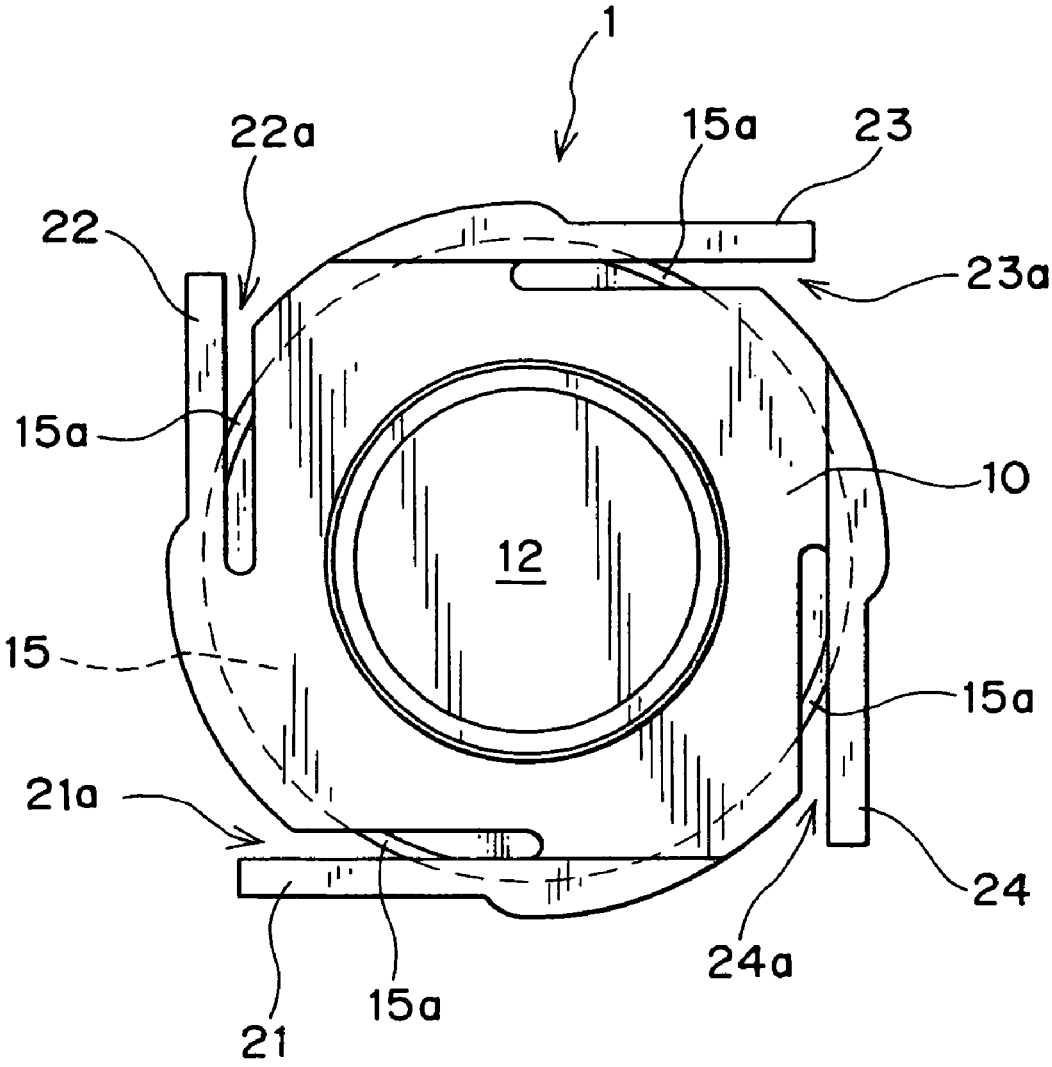
FIG. 3 is a front view of the cutter knife shown in FIG. 2 after assembled.
Figure 4:
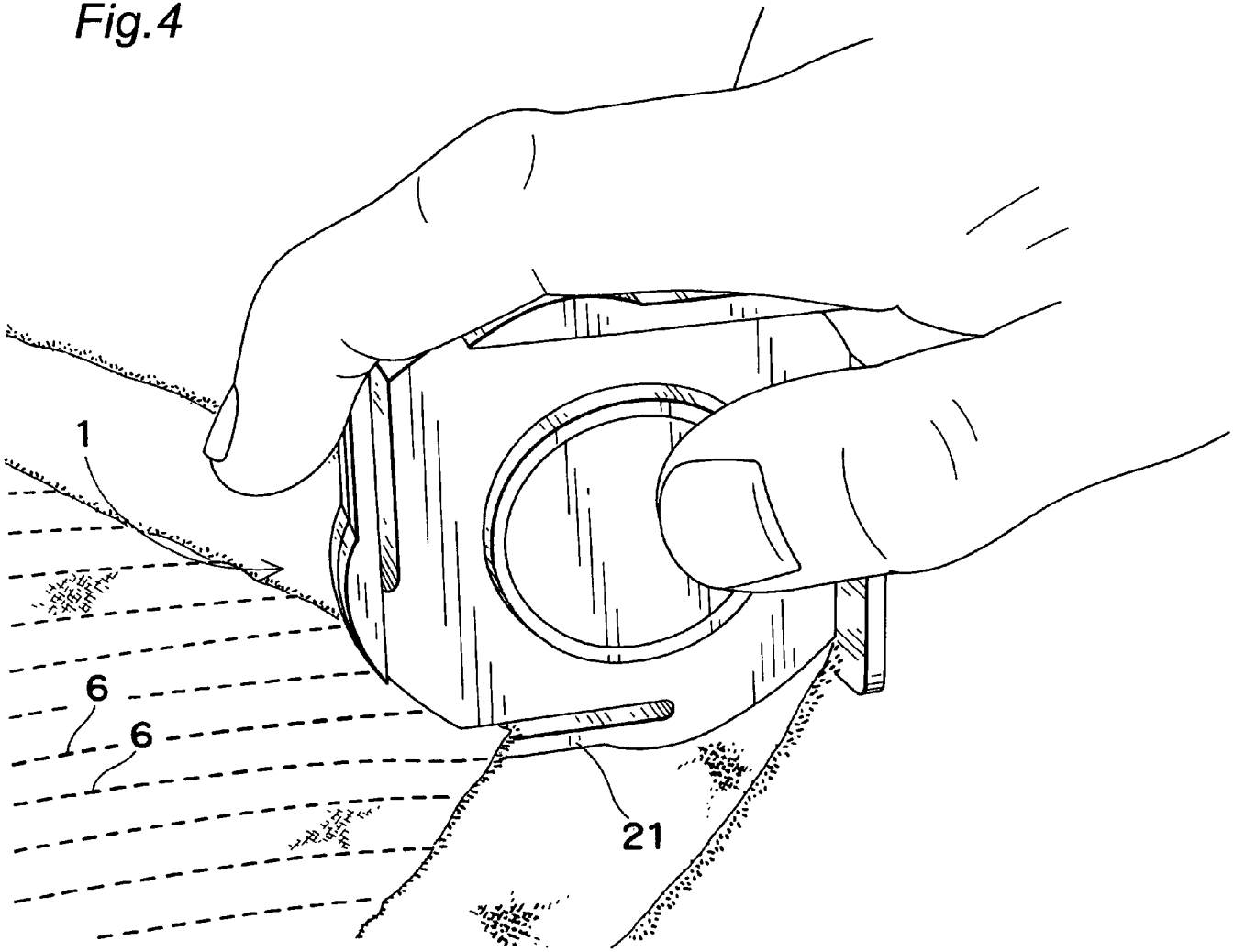
FIG. 4 is an explanatory view showing the practical use of the cutter knife shown in FIG. 3.

FIG. 2 shows an exploded perspective view of a cutter knife 1 for slash-quilts according to the first embodiment of the present invention, and FIG. 3 shows a front view of the assembled cutter knife 1.

Between two casing members 10*a* and 10*b* which constituting the casing 10 of the cutter knife 1, a rotary blade 15 is held. The two casing members 10*a*, 10*b* and the rotary blade 15 are assembled using a screw member 12, an annular plate member 17, a washer 18, and a nut 19.

Figure 5:
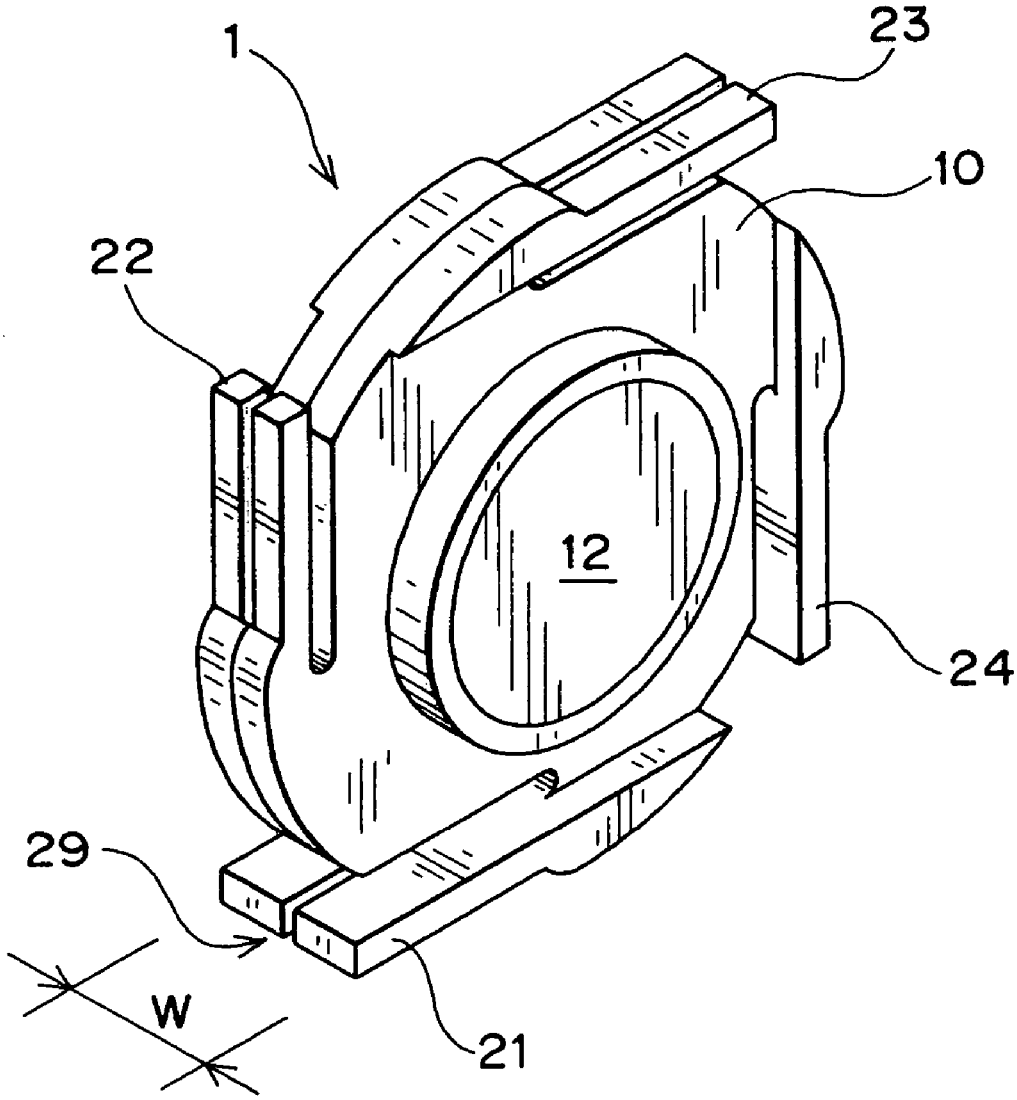
FIG. 5 is a perspective view of the cutter knife shown in FIG. 3.

As is well understood from FIG. 3, the cutter knife 1 is provided with four guide members 21, 22, 23 and 24, at the outer peripheral portion of the casing 10, which holds the rotary blade 15. All the guide members 21 to 24 have different widths ("W" in FIG. 5) from one another, and extend in parallel to the respective tangential line to the rotary blade 15. As can be seen in FIG. 5, the width dimension "W" extends perpendicular to the rotary blade. Slits 21*a* to 24*a* are formed between the guide members 21 to 24 and the casing 10, respectively, and the edge 15*a* of the rotary blade 15 is exposed in the respective slits 21*a* to 24*a*.

<<Manner of Use>>

In making a slash-quilt cloth, a user selects appropriate one guide member, from the four guide members 21 to 24, of which the width dimension fits the pitch width between the stitch lines 6. Then, the user inserts the selected guide member 21 between the stitch lines 6 of the quilt, and thus the slash-quilt within the slit 21*a*, and pushes the cutter knife 1 forward (or backward toward the user) so as to cut the quilt.

By using the selected guide member, it becomes possible to smoothly cut the quilt under a proper tension and also to correctly cut the quilt in straight along the center line between the stitch lines.

Since there is a variety sizes of the pitch width between the stitch lines 6, it is advantageous to selectively use a plurality of guide members having different widths. In the shown embodiment, the four guide members 21 to 24 having different widths ("W" in FIG. 5) are provided on one cutter knife 1. Thus, the user can appropriately select one suitable guide member from the four, depending on the pitch width between the stitch lines of the quilt, and cuts the quilt using the selected guide member, wherein exchanging of the guide members is not needed.

<<Cut Portion Provided in Guide Member>>

FIG. 5 shows the perspective view of the cutter knife 1 shown in FIGS. 2 and 3. The guide member 21 has a cut portion 29 formed therein, extending along its longitudinal direction. With such the cut portion 29 formed in the guide member 21, the width dimension "W" of the guide member 21 can elastically change, when an external force is applied from the outside to the inside of the guide member.

The guide member is one inserted between the stitching lines 6 of the quilt to apply a proper tension to the quilt to be cut. Thus, it is preferable that the width dimension "W" of the guide member is equal to or a little smaller than the pitch width between the stitching lines 6. When the cut portion 29 is not provided in the guide member, the width dimension "W" of one guide member is unchanged, and therefore, the pitch widths between the stitch lines to which such one guide member can be applied are limited.

On the other hand, when the cut portion 29 is provided in the guide member, it becomes possible to reduce the width dimension "W" of the guide member by the elastic deformation of the guide member, even if the width dimension "W" before the deformation is slightly larger than the pitch width between the stitching lines. Therefore, one guide member can be applied to some variation of pitch widths between the stitching lines, having some flexible range.

Since a plurality of guide members having different widths are provided to the cutter knife in the present invention, the cut portion 29 is not necessarily formed to the guide members. However, with such the cut portions formed to the guide members, in cooperation with the plurality of the guide members, one cutter knife would be applied to increased kinds of quilts having various pitch widths between stitch lines, so that the cutter knife can be more widely used. Therefore, it is preferable to form the cut portions to all of or at least some of the guide members.

<<Shape of the Casing of the Cutter Knife>>

In the shown embodiment, the casing 10 of the cutter knife is shaped in circular, and the four guide members 21 to 24 are provided at regular intervals on the outer peripheral portion of the casing 10. In the cutter knife 1, one rotary blade 15 is commonly used for the plurality of the guide members to cut a quilt, and thus, the distances between the center of the casing 10 and the respective guide members are substantially equal to one another. Accordingly, the circular shape is preferable for the casing 10 of the cutter knife 1. However, the shape of the casing 10 is not limited to a particular one. For example, other than the circular shape, regular polygonal shapes or other suitable shapes can be employed for the casing 10 of the cutter knife 1.

<<Number, Direction and Interval of the Guide Member>>

In the shown embodiment, the cutter knife 1 is provided with the four guide members 21 to 24. That is, a user can utilize the guide members of different 4 kinds of widths with one cutter knife, without exchanging the guide members.

However, the number of the guide members is not specifically limited in the present invention, and a suitable number of guide members can be provided on the cutter knife. In addition, the guide members are not necessarily disposed at regular intervals on the outer peripheral portion of the casing 10.

While all the guide members 21 to 24 shown in FIG. 3 are extending in clockwise direction on the outer peripheral portion of the casing, these guide members can be extending counterclockwise direction. Otherwise, all the guide members are not necessarily extending in the same direction. Some of the guide members can be extending clockwise direction, and others can be extending counterclockwise direction on the casing. However, the cutter knife can be more conveniently handled when all the guide members are extending in the same direction.

<<Modified Embodiment Provided with Handle>>

Figure 6:
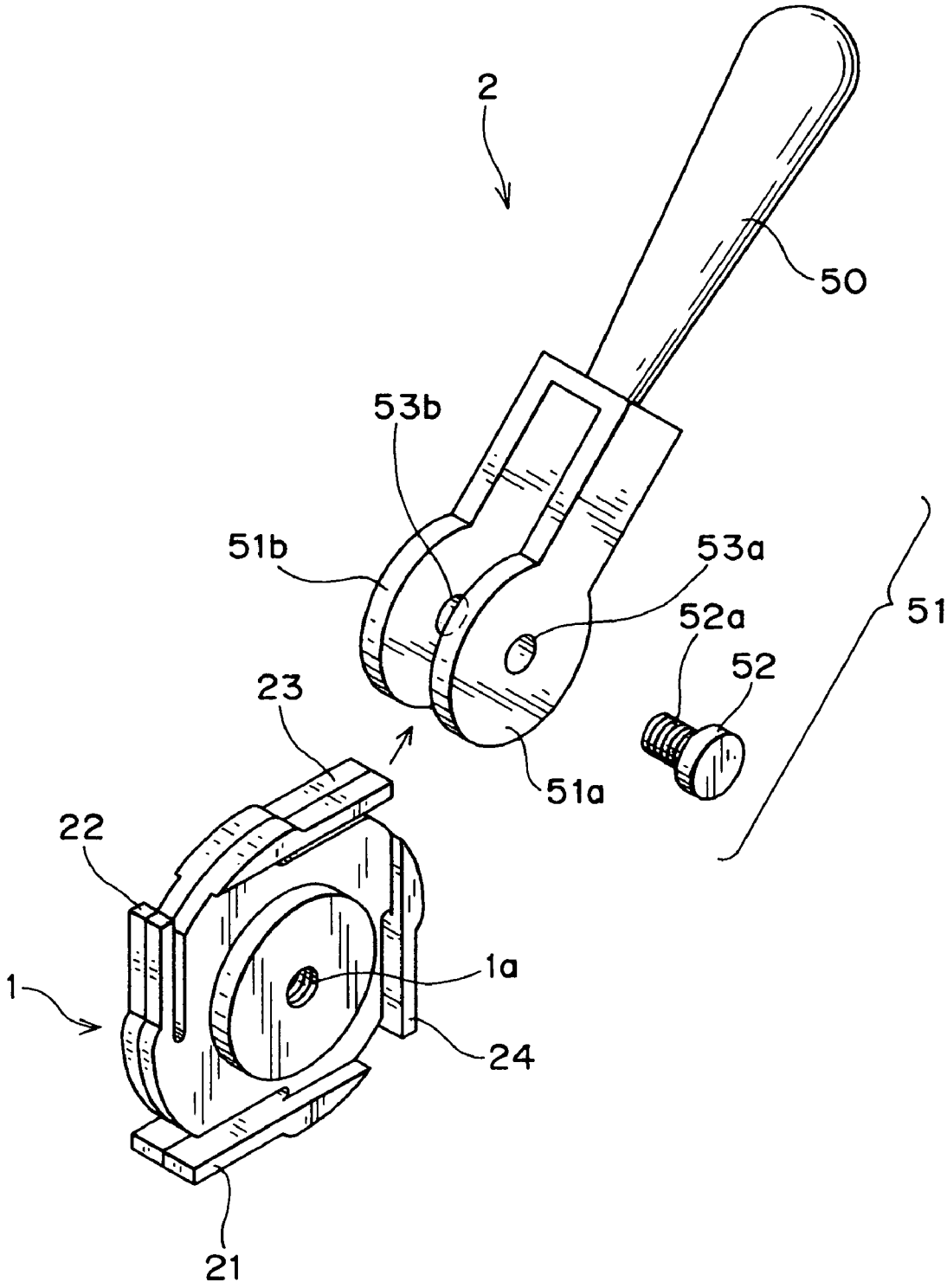
FIG. 6 is a perspective view of a modified embodiment of the cutter knife, which is provided with a handle.

FIG. 6 shows a modified embodiment, which is provided with a handle 2, by which the cutter knife 1 is handled to cut a quilt.

The handle 2 comprises a grip portion 50 to be grasped by a user, and a holder portion 51 for holding the cutter knife 1, which is provided on one end of the grip portion 50. The holder portion 51 has two opposing disc-like plates 51*a* and 51*b*, which have center through holes 53*a* and 53*b*, respectively.

As shown in FIG. 6, the side wall of the cutter knife 1 on this side in the drawing paper has a threaded hole 1*a* to be engaged with the threaded shaft 52*a* of the screw 52. On the other hand, the side wall of the cutter knife 1 on the opposite side in the drawing paper has a projection (not shown). This projection is inserted in the through hole 53*b*, and then, the screw 52 is fastened to lock the cutter knife 1 unrotatable. After the screw 52 is unfastened to rotate the cutter knife 1 to shift the angular position of the cutter knife 1, the screw 52 is again fastened. Thus, the user can select suitable one guide member from the guide members 21 to 24 for use.

Thanks to the handle 2, the user can firmly hold the cutter knife to cut the quilt. The structure of the handle 2 is not limited to one shown in FIG. 6, and any structure of the handle can be employed, as long as it can lock the cutter knife 1 not to rotate during the cutter knife is in cutting operation, and can appropriately adjust the angular position of the cutter knife 1 for selecting appropriate one guide member.

<<Modified Embodiment Provided with Holder>>

Figure 7:
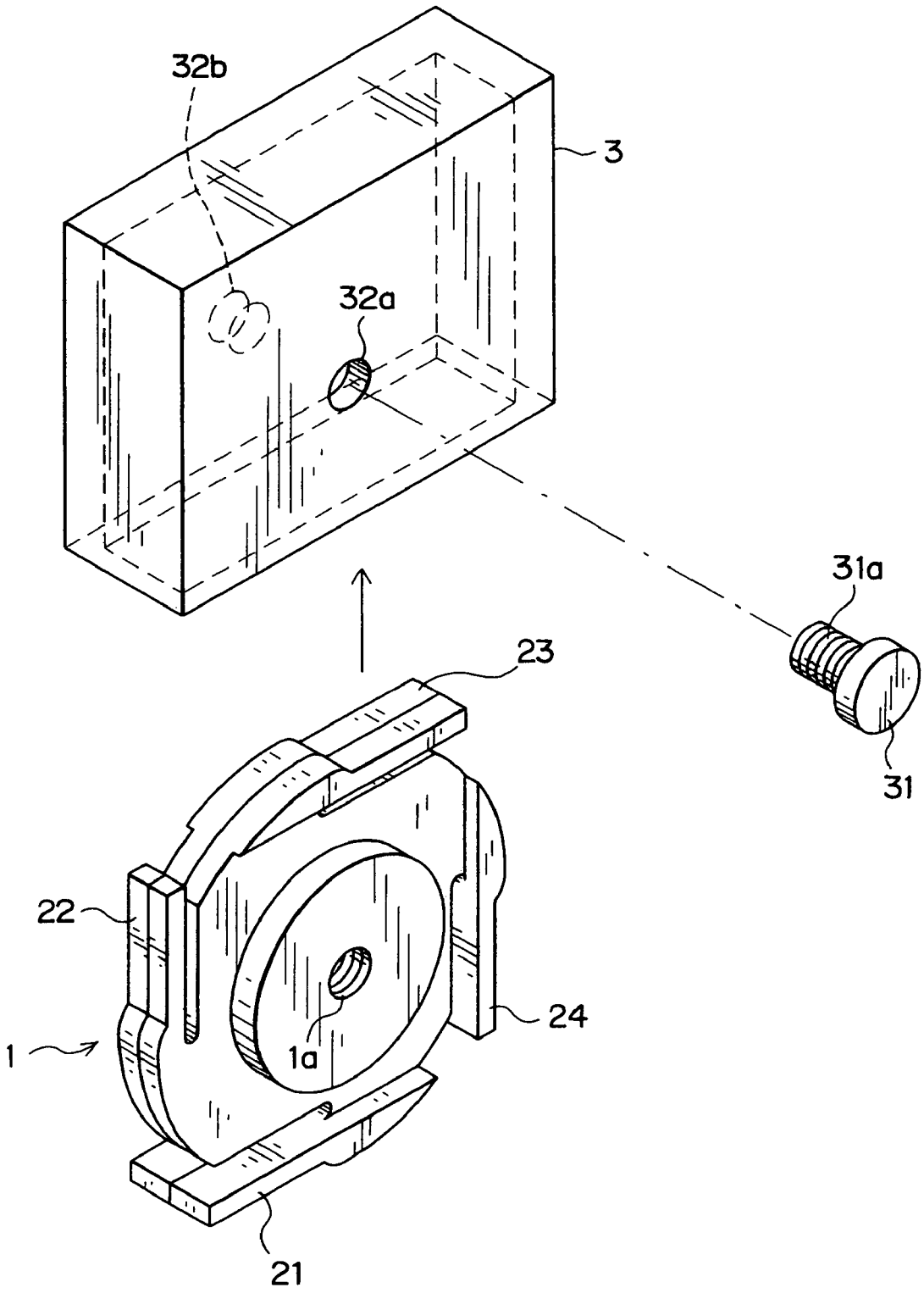
FIG. 7 is a perspective view of another modified embodiment of the cutter knife, which is provided with a holder.
Figure 8:
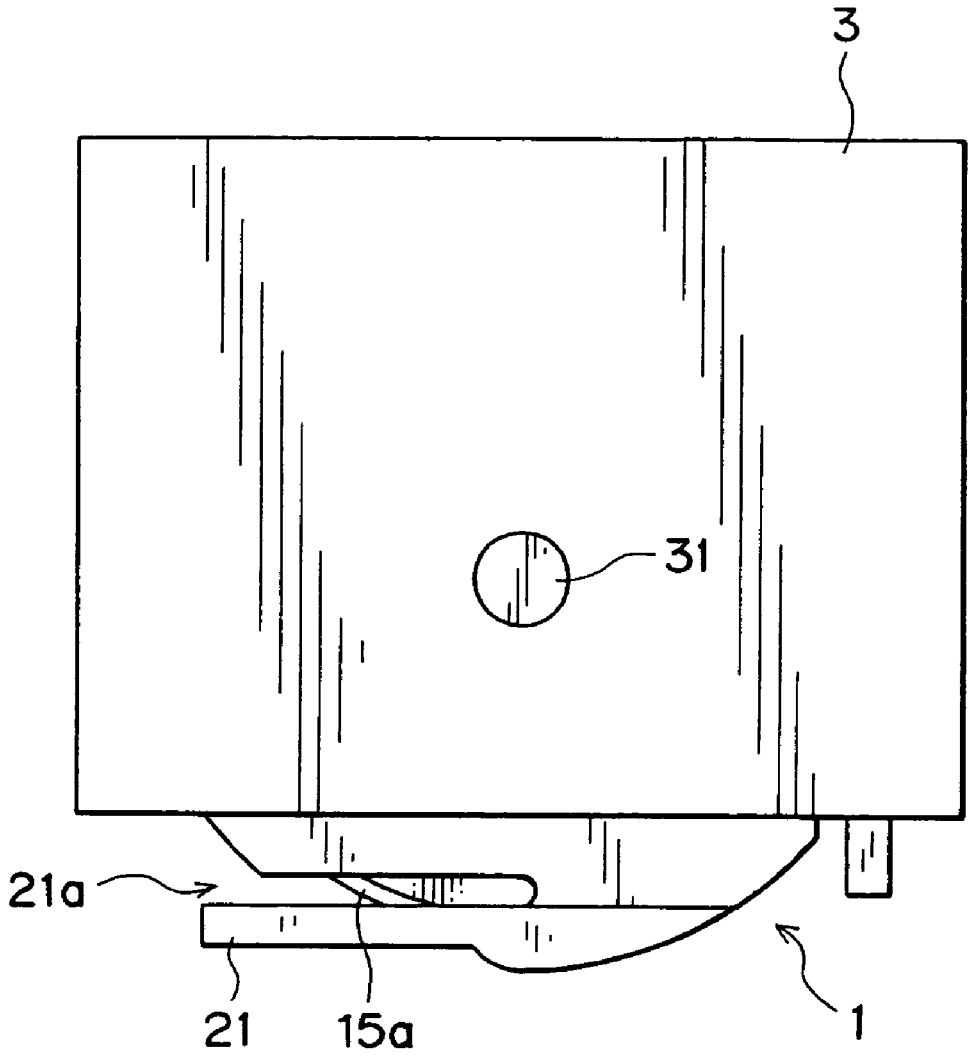
FIG. 8 is a front view of the cutter knife shown in FIG. 7 after assembled.

FIGS. 7 and 8 show another modified embodiment, which is provided with a holder 3 for handling the cutter knife 1 during a cutting operation. FIG. 7 shows the cutter knife 1 before housed in the holder 3, and FIG. 8 shows the cutter knife 1 after housed in the holder 3 and secured thereto.

The holder 3 is a hollow case-like member, which so holds the cutter knife 1 therein as to expose almost a half of the cutter knife 1 to external. That is, in FIG. 8, the cutter knife 1 is housed in the holder 3, such that one guide member 21 of the four members and the associated slit 21*a* are exposed to external.

In FIG. 7, the side wall of the holder 3 on this side in the drawing paper has a center through hole 32*a*. Similarly, the side wall on the opposite side has a center through hole 32*b*.

Like in the cutter knife in FIG. 6, the cutter knife 1 in FIG. 7 has a threaded hole 1*a* at the side wall on this side in the drawing paper which is to be engaged with the threaded shaft

31*a* of the screw 31, and also has a projection (not shown) at the side wall on the opposite side in the drawing paper. This projection is inserted into the through hole 32*b*, and then, the screw 31 is fastened to thereby lock the cutter knife 1 unrotatable. After the screw 31 is unfastened to rotate the cutter knife 1 to shift the angular position of the cutter knife 1, the screw 31 is again fastened. Thus, the user can select suitable one guide member from the guide members 21 to 24 for use.

Thanks to the holder 3, a user can firmly grasp the cutter knife 1 to cut a quilt. Moreover, the safety of the cutter knife 1 is improved, since the guide members and the edge of the rotary blade, which are not serving in cutting operation, are perfectly shielded from the external.

The structure of the holder 3 is not limited to one shown in FIGS. 7 and 8, and any structure of the holder can be employed, as long as it can lock the cutter knife 1 not to rotate during the cutter knife is in cutting operation, and can appropriately adjust the angular position of the cutter knife 1 for selecting appropriate one guide member.

Since the cutting operation is carried out using one exposed guide member, it is needed to expose one guide member and the associated slit to the external at minimum, when the cutter knife 1 is secured in the holder 3. But, how degree the cutter knife 1 is exposed from the holder 3 can be conveniently determined.

Note that, in the present invention, it is sufficient only that one cutter knife comprises a plurality of guide members having different widths, and blade edge is exposed in the respective slit formed alongside each of the guide members. Thus, the cutter knife of the present invention does not always comprise a single rotary blade 15, and a plurality of separate blades can be disposed in the respective slits. In that case, the shape of the casing of the cutter knife can be variously formed, other than circular.

Second Embodiment

An Improvement to Effectively Utilize Up Almost of the Blade Edge

The rotary blade 15 can be secured to the casing 10 of a cutter knife to be rotatable during a cutting operation, or otherwise, can be unrotatable during a cutting operation.

When the rotary blade 15 is secured to the casing to be unrotatable during a cutting operation, the sharpness of the blade edge can be recovered as follows, when the sharpness of the blade edge has been deteriorated: the holding position of the rotary blade is slightly shifted to expose a fresh edge portion of the blade in the respective slits 21*a* to 24*a* to thereby recover the sharpness of the cutter knife. However, since human eyes can not recognize the degree of the degradation of blade sharpness, some idea is needed to prevent the deteriorated edge portions of the blade from again exposed in the slits 21*a* to 24*a*. The second embodiment of the present invention is devised in order to prevent such the disadvantage. The second embodiment will be described below with reference to FIGS. 9 and 10.

Figure 9:
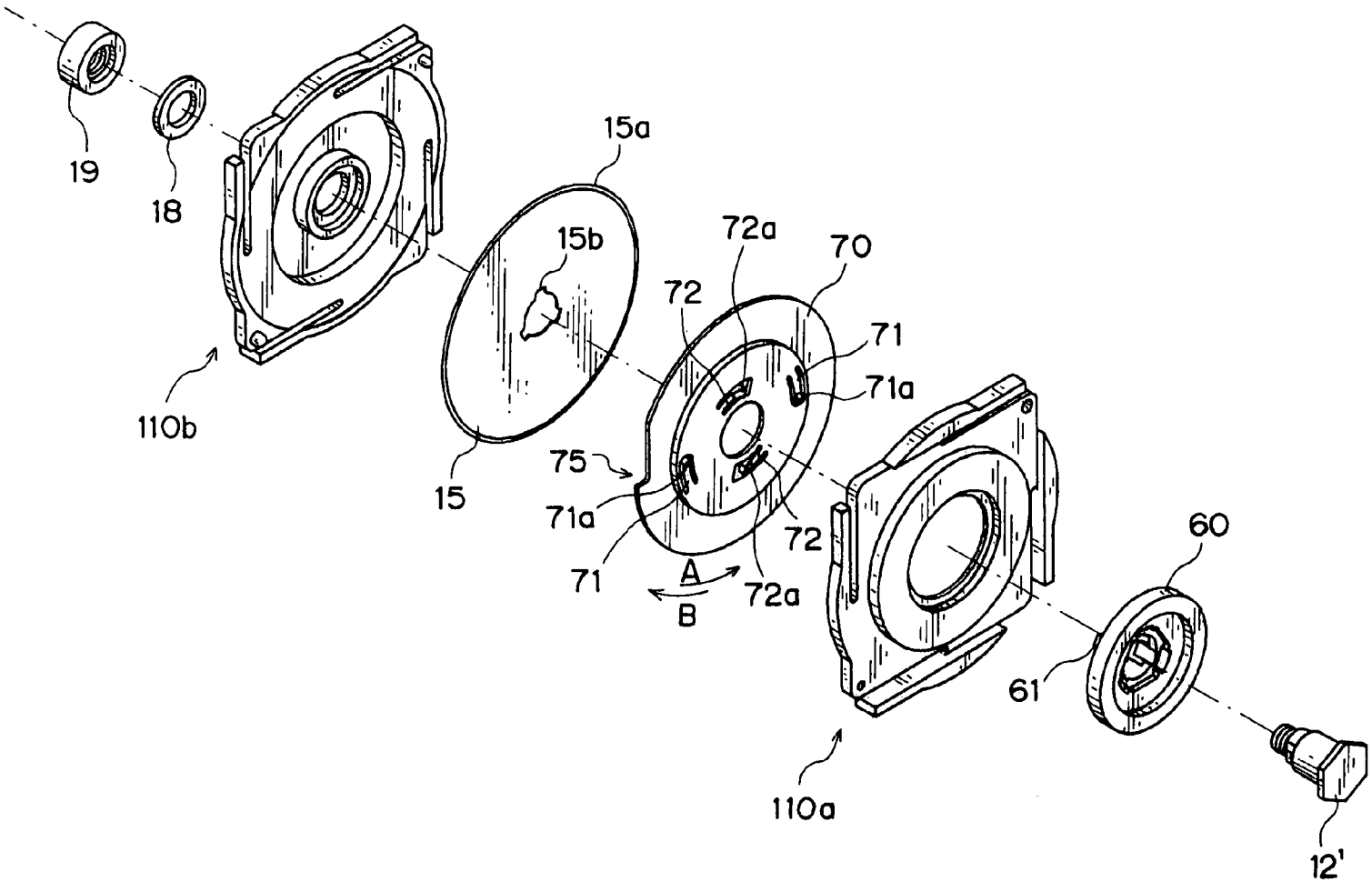
FIG. 9 is an exploded perspective view of a cutter knife according to the second embodiment of the present invention.
Figure 10:
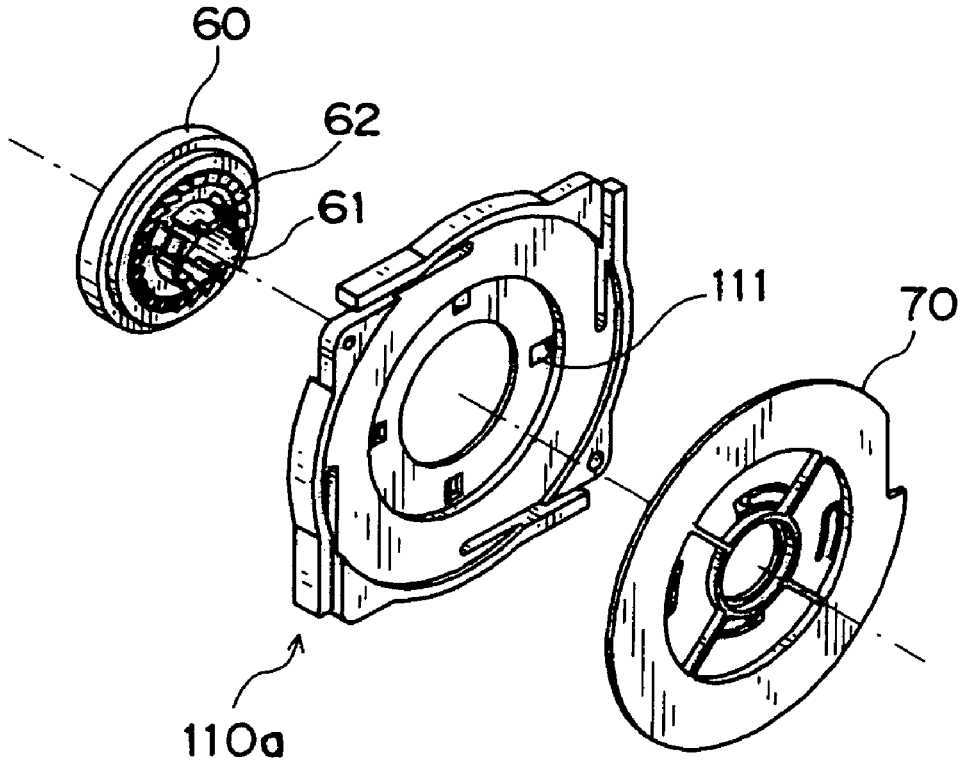
FIG. 10 is an exploded perspective view, showing a part of FIG. 9 from the opposite side.

FIG. 9 shows an exploded perspective view of the second embodiment of the present invention. FIG. 9 substantially differs from FIG. 2, in that a dial member 60 and a blade cover 70 are additionally provided. Thus, explanations will be made on only these different structures. FIG. 10 is a perspective view showing the dial member 60, the casing member 110*a* and the blade cover 70 in FIG. 9, from the opposite side.

<<(1) Relationship Between the Dial Member 60 and the Rotary Blade 15>>

The dial member 60 has three projections 61 on its reverse side, and the three projections 61 are to engage respectively with the three notches 15*b* formed to the center hole of the rotary blade 15. After the cutter knife is assembled, the rotary blade 15 always rotates together with the rotation of the dial member 60 in the directions "A" and "B" in FIG. 9.

<<(2) Structure of the Blade Cover 70>>

The blade cover 70 is formed having a diameter equal to or a little larger than the diameter of the rotary blade 15, and having a cutoff portion 75 formed at one position of its outer peripheral portion. After the cutter knife is assembled, the edge 15*a* of the rotary blade 15 is exposed to external only at the cutoff portion 75 of the blade cover 70, and thus can be used for cutting operation only at this position.

The blade cover 70 has two pairs of elastic projections (71, 71) and (72, 72), which are formed on its side face. Each of these elastic projections 71, 71 and 72, 72 is provided as follows: the side face of the blade cover 70 is cut in U-like shape to form an arm-like portion, and an axially raised tip portion 71*a*, 71*a* or 72*a*, 72*a* is provided on the free end of the arm-like portion.

The location of the first pair of the elastic projections 71 and 71 in radial direction on the blade cover is different from that of the second pair of the elastic projections 72 and 72. That is, the elastic projections 71 and 71 are disposed in opposed to each other on a concentric circle, and the elastic projections 72 and 72 are disposed in opposed to each other on anther concentric circle having a smaller radius.

<<(3) First Ratchet Mechanism>>

The first pair of elastic projections 71 and 71 constitutes a first ratchet mechanism, in cooperation with the recesses 111 formed on the reverse side of the casing member 110*a*. That is, after the cutter knife is assembled, tip portions 71*a* and 71*a* on the elastic projections 71 and 71 enter the recesses 111, and thereby, the blade cover 70 becomes rotatable only in the direction "A" in FIG. 9 (a first direction) relative to the casing member 110*a*, and becomes unrotatable in the opposite direction "B" in FIG. 9 (a second direction) relative to the casing member 110*a*.

In this regard, this kind of the ratchet mechanism is generally known: the tip portion 71*a* is engaged in the recess 111 to thereby inhibit the relative rotation of the blade cover 70 in one direction, while the tip portion 71*a* escapes from the recesses 111 by the cam action, which is realized by an inclined face provided on side wall in the recess 111, thereby the relative rotation of the blade cover 70 in the opposite direction is allowed. Of course, it is possible to employ other ratchet mechanism having a similar function.

<<(4) Second Ratchet Mechanism>>

The second pair of elastic projections 72 and 72 constitutes a second ratchet mechanism, in cooperation with the annular teeth portion 62 formed on the reverse side of the dial member 60. That is, after the cutter knife is assembled, the tip portions 72*a* of the elastic projections 72 are engaged with the annular teeth portion 62, such that the dial member 60 can drive the blade cover 70 to rotate only in the direction "A" in FIG. 9.

More specifically, when the dial member 60 is rotated in the direction "A" (the first direction), the blade cover 70 is driven to rotate therewith in the direction "A". To the contrary, when the dial member 60 is rotated in the opposite direction "B" (the second direction), the blade cover 70 is not driven and remaining there.

This ratchet mechanism is also well known. Each tooth of the annular teeth portion 62 has an inclined face and an upright face. The upright face is engaged with the tip portion

72*a* to thereby inhibit the relative rotation in one direction, while the cam action by the inclined face disengages the tip portion 72*a* from the annular teeth portion 62 to thereby allow the relative rotation in the opposite direction. Of course, it is possible to employ other ratchet mechanism having a similar function.

<<(5) Manner of Use>>

Since the rotary blade 15 can be utilized for cutting only in the cutoff portion 75 of the blade cover 70, the dial member 60 is rotated in the direction "A" (the first direction) in FIG. 9 to expose the blade edge 15*a* in one of the slits 21*a* to 24*a* (see FIG. 3). For example, when the guide member 22 is utilized for cutting, the blade edge 15*a* is exposed in the associated slit 22*a*. When another guide member is used, the dial member 60 is accordingly rotated in the direction "A" to expose the blade edge 15*a* in a desired slit. It must be noted that, regardless which of the guide members is used, the same edge portion of the blade is always utilized for cutting operation.

As already described, when the dial member 60 is rotated in the direction "A", both of the rotary blade 15 and the blade cover 70 rotate together in the direction "A". Thus, the same edge portion of the blade can be always utilized for cutting operation, by rotating the dial member 60 in the direction "A".

When the sharpness of the edge portion in the cutoff portion 75 has deteriorated due the frequent use, a different edge portion of the blade can be located in the cutoff portion 75 of the blade cover 70, by rotating the dial member 60 in the direction "B" (the second direction).

As already described, when the dial member 60 is rotated in the direction "B", the rotary blade 15 is rotated together with the dial member 60 while the blade cover 70 is still remaining there without rotating. Therefore, the rotary blade 15 is rotated in the direction "B" relative to the blade cover 70, and consequently, a different portion of the blade edge 15*a* is located in the cutoff portion 75 of the blade cover 70.

Thereafter, like as above-mentioned, the dial member 60 is rotated in the direction "A" to expose the fresh edge portion in a desired slit selected from the slits 21*a* to 24*a* (see FIG. 3) for cutting operation. When the sharpness of this edge portion has deteriorated, the dial member 60 is rotated in the direction "B", in order to locate further fresh edge portion in the cutoff portion 75 of the blade cover 70 for cutting operation. Repeating the same steps, all of the circumferential edge portion 15*a* of the rotary blade can be effectively utilized up.

For example, when the pitch of the second ratchet mechanism is set in an appropriate value, a fresh edge portion of the blade can be located in the cutoff portion 75 for cutting operation, with only one click of rotation of the dial member 60 in the direction "B".

Preferably, an indicating means is provided on the dial member 60 (or other locations), which indicates that the dial member 60 has been rotated up by one rotation in the direction "B" relative to the blade cover 70. When the dial member 60 has been rotated up by one rotation in the arrow direction B relative to the blade cover 70, it means that the overall circumferential edge 15*a* has been used up. Thus, the user would know that it is time to exchange the rotary blade with a new one.

Note that, also in the second embodiment, the shape of the casing of the cutter knife, the number of the guide members, and the direction or intervals of the guide members are not limited to those shown in the figures, and they can be appropriately modified, like in the first embodiment. Further, a modified embodiment, which is provided with a handle (see FIG. 6) or a holder (see FIGS. 7 and 8) would be also possible.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A cutter knife for slash-quilts, comprising:

a planar casing;

a plurality of guide members extending outwardly from the outer peripheral portion of the casing and in a direction substantially parallel to the plane of the casing and terminated at a free end, wherein each of the plurality of guide members has a different width dimension and wherein the width dimension extends perpendicular to the plane of a rotary blade which is mounted in the casing and substantially parallel to the plane of the casing; and a plurality of slits formed between each of the guide members and the casing of the cutter knife, in each of the slits a blade edge which is formed along the periphery of the rotary blade is exposed, and wherein a slash-quilt is receivable within the plurality of slits and is cut by the blade edge.

2. The cutter knife for slash-quilts of claim 1, wherein:

at least one of the guide members is provided with a cut portion extending in a longitudinal direction of the guide member, by which the width dimension of the guide member is elastically changed under an external force.

3. The cutter knife for slash-quilts of claim 1, wherein:

the casing of the cutter knife holds the rotary blade;

the guide members are provided at outer peripheral portion of the casing, extending in parallel to respective tangential line to the rotary blade; and an edge of the rotary blade is exposed in each of the slits.

4. The cutter knife for slash-quilts of claim 3, wherein:

the casing of the cutter knife is formed in circular shape or regular polygonal shape.

5. The cutter knife for slash-quilts of claim 3, wherein:

all of the guide members extend in a same direction, clockwise or counterclockwise direction, relative to the casing of the cutter knife.

6. The cutter knife for slash-quilts of claim 3, further comprising:

a handle coupled to the casing so that a user can grasp the handle and conduct a cutting operation with the cutter knife.

7. The cutter knife for slash-quilts of claim 3, further comprising:

a holder, coupled to the casing such that one of the guide members and one of the slits associated thereto are exposed to external at minimum, and which a user grasps to conduct a cutting operation with the cutter knife.

8. The cutter knife for slash-quilts of claim 3, wherein:

the rotary blade is held by the casing of the cutter knife, in a superposed condition with a blade cover, the blade cover having at least the same diameter as that of the rotary blade, and a cutout portion being formed at outer peripheral portion of the blade cover, in which an edge of the rotary blade is exposed;

a dial member is provided on a side face of the casing of the cutter knife, which is connected to the rotary blade and is intended for rotationally driving the rotary blade in both of a first and a second directions to adjust the angular position of the rotary blade;

the blade cover is associated with the casing of the cutter knife via a first ratchet mechanism, such that the blade cover can rotate relative to the casing in the first direction and can not rotate relative to the casing in the second direction;

the dial member is associated with the blade cover via a second ratchet mechanism, such that the dial member can rotationally drive the blade cover in the first direction and can not rotationally drive the blade cover in the second direction;

when the dial member is rotated in the first direction relative to the casing of the cutter knife, the rotary blade and the blade cover together rotate in the first direction, so that a portion of the blade edge exposed in the cutout portion of the blade cover can be located in a desired one of the slits; and when the dial member is rotated in the second direction relative to the casing of the cutter knife, the rotary blade is rotated in the second direction relative to the blade cover, so that another portion of the blade edge can be exposed in the cutout portion of the blade cover.

* * * * *